United States Patent [19]

Regan, deceased

[11] Patent Number: 4,535,719

[45] Date of Patent: Aug. 20, 1985

[54] LIQUID DISPENSING GUN WITH SUBSTRATE SEPARATOR

[75] Inventor: Donald J. Regan, deceased, late of Kennesaw, Ga., by Joyce H. Regan, heir

[73] Assignee: Nordson Corporation, Amherst, Ohio

[21] Appl. No.: 597,445

[22] Filed: Apr. 6, 1984

[51] Int. Cl.[3] ..... B05C 3/02

[52] U.S. Cl. ..... 118/410; 118/710; 118/711

[58] Field of Search ..... 118/410, 305, 411, 415, 118/677, 684, 685, 207, 710, 711, 663; 401/48, 193, 101, 103; 141/193, 275, 276

[56] References Cited

U.S. PATENT DOCUMENTS

| | | | |
|---|---|---|---|
| 3,501,064 | 3/1970 | Gaumer | 222/358 |
| 3,791,590 | 2/1974 | Dieter | 239/459 |
| 4,291,642 | 9/1981 | Kolc | 118/415 |
| 4,301,698 | 11/1981 | Saint Georges Chaumet | 81/468 |

*Primary Examiner*—Norman Morgenstern
*Assistant Examiner*—Kenneth Jaconetty
*Attorney, Agent, or Firm*—Wood, Herron & Evans

[57] ABSTRACT

A liquid dispensing gun for applying a liquid to a substrate which includes a movable valve stem for opening and closing a liquid-dispensing valve and a deflector plate movable in conjunction with the valve stem to deflect the substrate away from the gun when the valve is closed. The deflector plate is activated by a pair of linearly translated push rods which are coupled through a push rod beam and piston to the valve stem so that the valve stem and deflector plate move in unison.

8 Claims, 3 Drawing Figures

LIQUID DISPENSING GUN WITH SUBSTRATE SEPARATOR

DESCRIPTION OF THE INVENTION

This invention relates to dispensing guns for applying a liquid to a substrate and more particularly concerns a dispensing gun having a deflector element for deflecting the substrate away from the gun when a fluid-dispensing valve in the gun is closed.

In a number of systems for automatically dispensing a liquid onto a substrate, the liquid is intermittently applied to the substrate. For example, a dispensing gun may be employed to intermittently apply the liquid to the substrate. Usually, it is desirable to only dispense the liquid from the gun during the intermittent application times. This is true, for example, in applying hot melt adhesive in an intermittent pattern to a moving continuous paper strip. An illustrative hot melt adhesive dispensing system shall be described hereinafter in which hot melt adhesive is dispensed from an adhesive dispensing gun.

In the illustrative hot melt adhesive dispensing gun, the heated adhesive is supplied under pressure to an adhesive storage chamber in the gun and coupled through a valve to a nozzle which contacts the moving substrate and applies the adhesive thereon. The flow of adhesive to the nozzle is controlled by opening and closing the valve. The valve is intermittently opened for the required amount of time to place the desired adhesive pattern on the substrate as it moves past the nozzle. In the past, the control of the valve itself has proved to be insufficient to provide sharp cut-on and cut-off of the elements of the adhesive pattern applied to the substrate. Sharp cut-off means that the adhesive does not trail onto the substrate after the dispensing valve has been closed. Sharp cut-on means that the amount of adhesive dispensed onto the substrate does not gradually increase when the dispensing valve is opened. For example, when the dispensing valve of a hot melt gun is closed, a certain amount of residual adhesive can be wiped from the nozzle onto the substrate after the valve has been closed. If this occurs, sharp cut-off of the adhesive is not obtained.

In some adhesive dispensing systems, the width of the adhesive applied to the substrate may be relatively large such as a number of inches or more. This requires the use of a nozzle of comparable width, and this width is considerably greater than the dimensions of the valve for controlling the flow of the adhesive to the nozzle. The valve is typically located somewhat upstream of the nozzle outlet. Therefore, there is inherently a volume of adhesive in the nozzle beyond the valve, and therefore not controllable by the valve. Consequently, despite precision in controlling the opening and closing of the valve in the adhesive dispensing gun, there is always a certain amount of adhesive beyond the control of the valve limiting sharp cut-on and cut-off of the individual elements of an intermittent pattern of adhesive application on a substrate.

It is the general aim of the invention to provide a liquid-dispensing gun, such as for dispensing a liquid adhesive, which produces sharp cut-off definition in the application of the liquid to a substrate. It is a further objective of the invention to provide such a liquid-dispensing gun which also produces sharp cut-on definition in the intermittent application of a liquid to a substrate.

These objectives have been accomplished in accordance with certain principles of the invention by providing a liquid-dispensing gun having a valve-controlled liquid flow through a nozzle onto a substrate, with a deflector element mounted on the gun movable in response to closing of the valve to deflect the substrate away from the nozzle.

Other objects and advantages of the invention, and the manner of their implementation, will become apparent upon reading the following detailed description and upon reference to the drawings, in which.

Figure 2:
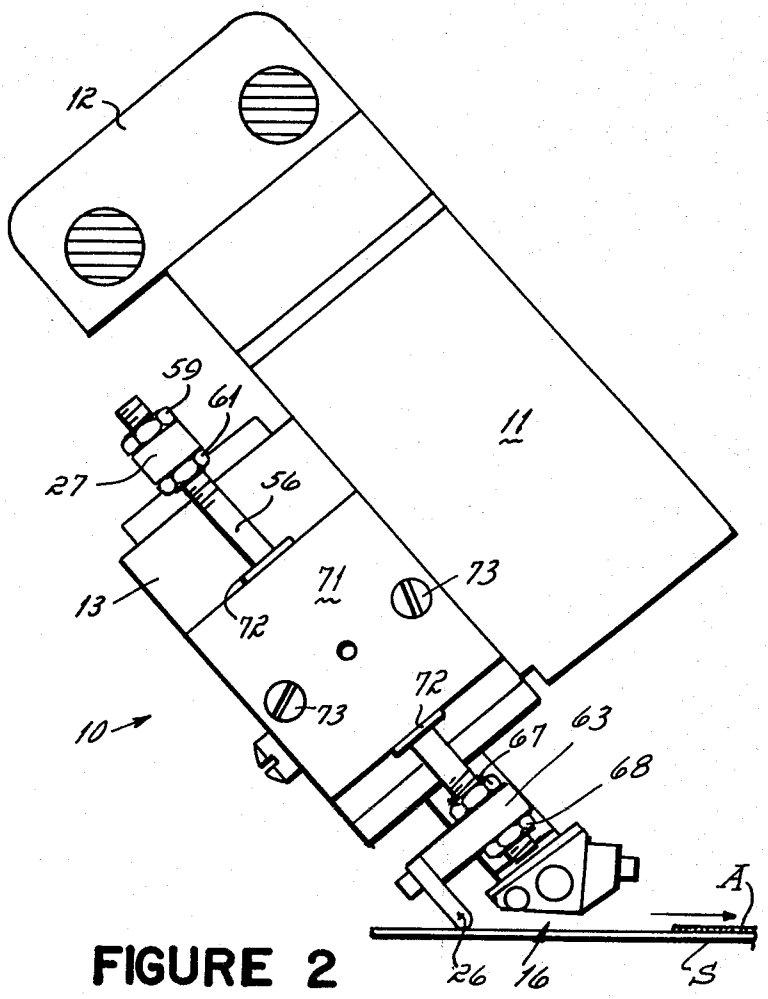
FIG. 2 is a side view of the gun of FIG. 1 showing the gun in a non-dispensing configuration wherein the substrate is deflected away from the nozzle.
Figure 1:
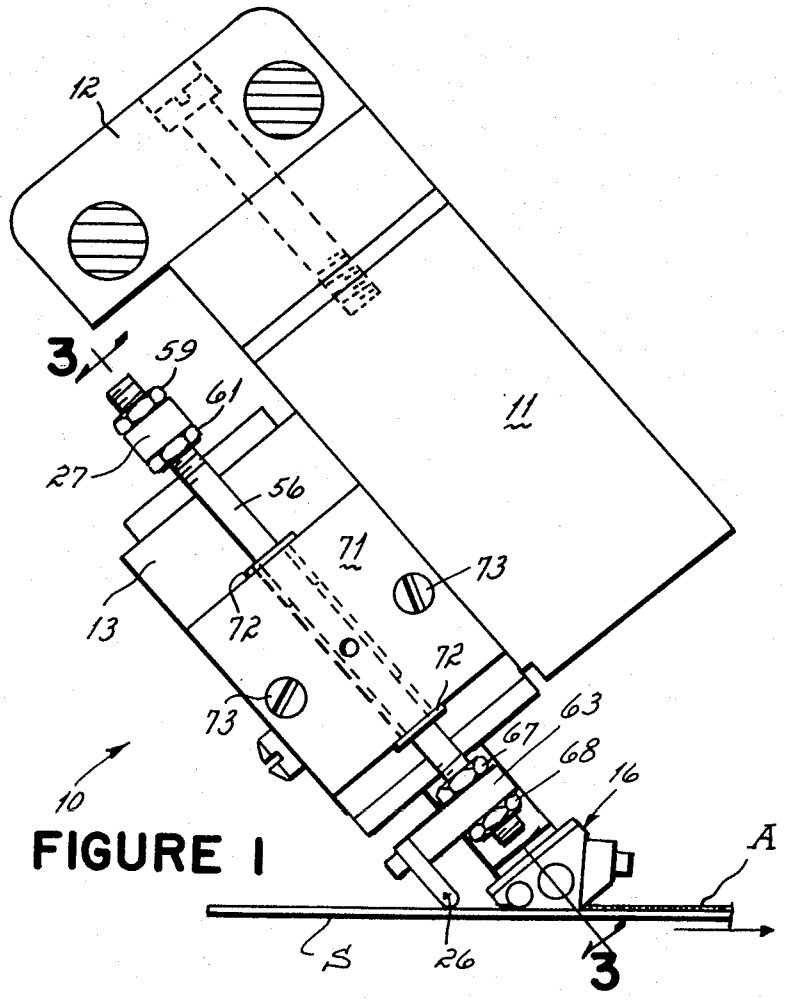
FIG. 1 is a side view of a liquid-dispensing gun constructed in accordance with the present invention shown in a dispensing position wherein the nozzle of the gun is in contact with a substrate.
Figure 3:
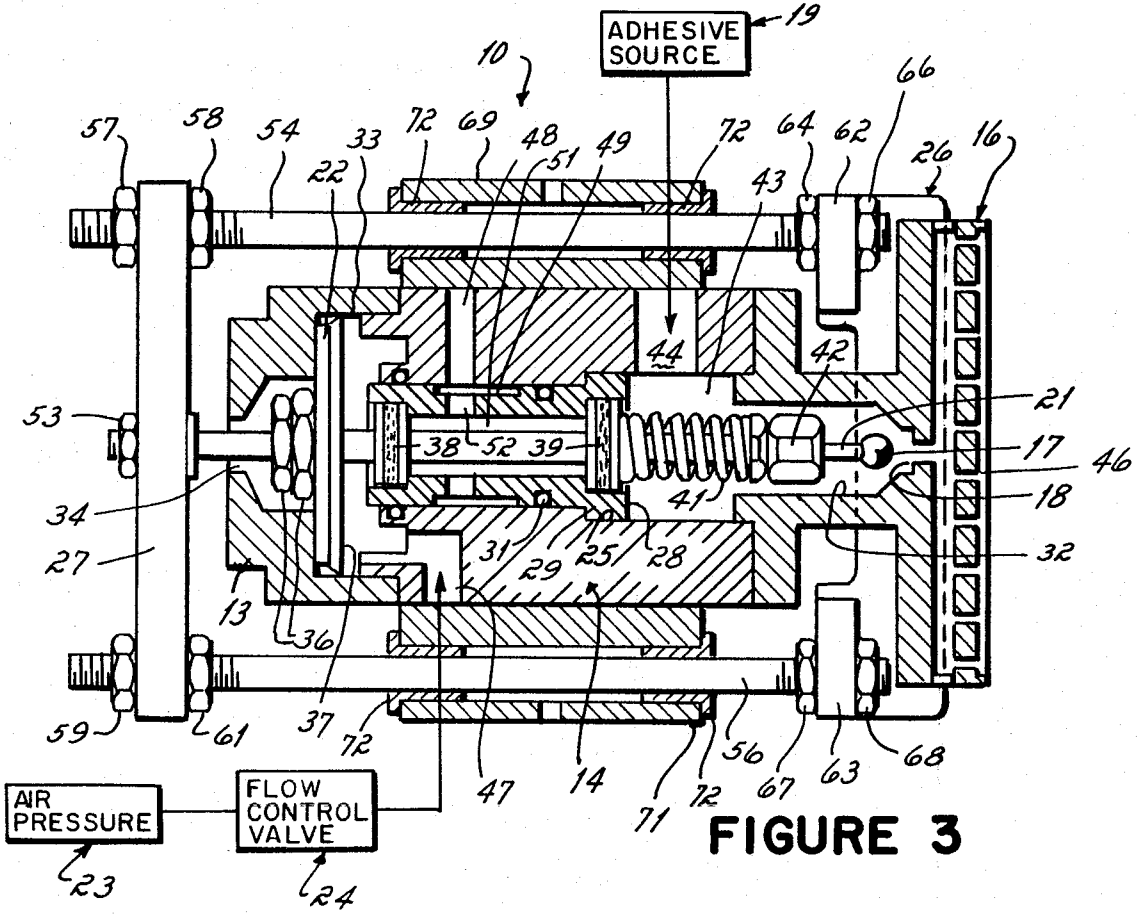
FIG. 3 is a sectional view of the gun of FIG. 1 taken along the line 3—3.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

For example, the invention shall be described herein in relation to a hot melt adhesive dispensing gun. However, the invention is equally applicable to other types of liquid dispensers wherein a liquid is dispensed onto a substrate which may be deflected away from dispenser.

With reference now to the figures, a hot melt adhesive dispensing gun 10 is mounted on a service module 11, which is in turn rigidly attached to a mounting block 12. The service module 11 not only rigidly mounts the gun 10, but also includes manifolds (not shown) for coupling adhesive valve-controlling pressurized air and hot melt adhesive to the gun, as shall be described hereinafter.

The gun 10 includes a gun housing made up of an end cap 13, a gun body 14 and a slot nozzle, or extrusion head, 16 which dispenses adhesive A onto a substrate S. In order to control the flow of hot melt adhesive, a ball valve made up of a ball 17 and a seat 18, defined by the nozzle 16, is provided in the path of flow of the adhesive from an adhesive source 19 to the nozzle 16. To open and close the ball valve, the ball 17 is carried on the end of a valve stem 21 coupled to a piston 22 which reciprocates to open and close the valve. Movement of the piston is effected by pressurized air from an air pressure source 23 supplied through a flow control valve 24.

In accordance with the invention, a depressor bar 26 is movably mounted on the gun 10 and is operable to deflect the substrate S away from the nozzle 16 (as shown in FIG. 2) when the ball valve is closed. To provide the desired movement of the depressor bar 26, the bar is mechanically coupled through a push rod beam 27 to the piston 22 so that movement of the valve ball 17 results in movement of the depressor bar 26.

Considering the operation of the gun 10 in more detail, the gun body 14 contains a stepped axial bore 25. A bushing 28 is mounted within the smaller diameter rear section of this bore. The bushing 28 has a flange 29 at its forward end which abuts a shoulder located between the two different-diameter sections of the bore 25. O-ring seals 31 are contained within annular recesses in the periphery of the bushing 28 in order to maintain a seal between the peripheral surface of the bushing and the bore 25. There is also provided an axial bore 32 in the extrusion head 16 in which the valve stem 21 and valve ball 17 move.

The valve ball and valve stem are driven by a pneumatic motor made up of the piston 22 and a cylinder 33 in the end cap 13. The cylinder bore is open to atmosphere through a vent port 34. The piston 22 is fixedly secured to the valve stem 21 by a pair of lock nuts 36. Secured to the underside of the piston 22 is a lip seal 37 which contacts the wall of the cylinder 33 in order to form a pneumatic seal about the underside of the piston.

The valve stem 21 extends between the piston 22 and the valve ball 17, and in so doing, fixedly interconnects the two such that movement of the piston effects corresponding opening and closing of the valve. Between the piston and the valve, the valve stem 21 passes through a pair of spaced packing seals 38, 39. These packing seals are mounted in the opposite ends of the bushing 28 so as to form a seal between the interior surface of the bushing and the exterior surface of the valve stem. Located between the valve ball 17 and the lower packing seal 39, there is a compression spring 41. The spring is engageable at one end with a nut 42 secured to the valve stem and at the other end with the packing seal 39 so that it biases the valve into a closed position.

Surrounding the compression spring 41, is an adhesive storage chamber 43 which communicates with the valve seat 18. The adhesive storage chamber is connected to a pressurized source of adhesive by means of a port 44 so that whenever the valve is open, the adhesive flows from the adhesive source 19 by way of the manifold (not shown) in the service module 11, through the port 44 and the chamber 43, and through the valve seat to and through the elongated nozzle orifice 46.

In order to connect the underside of the pneumatic motor to a source of air pressure sufficient to actuate the pneumatic motor against the bias of the spring 41, there is a pneumatic port 47 which extends through the gun body 14 and communicates with the cylinder 33. Air pressure supplied to the port 47 from the air pressure source 23 causes the piston 22 to move upwardly against the bias of the spring 41 and thereby open the valve.

Preferably, vent ports 48 through the gun body 14 connect an annular groove 49 formed in the periphery of the bushing 28 to atmosphere. This groove 49 is also open to the interior bore 51 of the bushing by ports 52 which extend through the side walls of the bushing. The purpose of these vents 48, 52 is to connect the bore 25 in the gun body and the bore 51 in the bushing to atmosphere so that any adhesive which inadvertently seeps from the liquid chamber upwardly around the seals does not reach the pneumatic motor. Instead, that seepage of adhesive is vented to atmosphere through the vent ports.

In operation of the dispensing gun 10, hot melt adhesive under pressure from an adhesive supply source is maintained in fluid communication with the storage chamber 43 of the gun. Consequently, adhesive stored under pressure in the chamber 43 is available to flow from the gun 10 through the nozzle orifice 46 in the event that the valve is opened. When the valve is to be opened, air under pressure from the source 23 is supplied to the port 47 of the gun through the flow control valve 24. The flow control valve 24 may be opened and closed by any conventional actuator, such as, for example, an electrical switch actuated solenoid or a pneumatic motor controlled by a pneumatic switch. Whenever air under pressure is supplied to the port 47, it causes the piston 22 to move upwardly, thereby moving the valve ball 17 upwardly and off of the valve seat 18. This results in liquid flow from the chamber 43, through the valve, and subsequently to the nozzle orifice 46.

In accordance with the invention, the movement of the valve stem 21 is coupled to the depressor bar 26 so that the substrate S is deflected from the nozzle 16 when the valve is closed. To accomplish this, the valve stem 21 is secured to the push rod beam 27 which is in turn connected to the depressor bar 26.

The valve stem 21 is attached to the push rod beam 27 by a nut 53 received on a threaded end portion of the valve stem. A pair of push rods 54, 56 are spaced apart laterally from the gun body and are each secured at one end to the push rod beam 27 and at the other end to the depressor bar 26. The push rods 54, 56 are threaded at each end. The rear end of each push rod 54, 56 is secured to the push rod rod beam 27 by a pair of nuts 57, 58 and 59, 61, respectively.

The forward end of each push rod 54, 56 is secured to a separate one of a pair of depressor bar mounting blocks 62, 63. Each depressor bar mounting block 62, 63 is rigidly secured to the depressor bar 26. The forward threaded ends of the push rods 54, 56 are secured to the depressor bar mounting blocks by nuts 64, 66 and 67, 68, respectively.

In order to assure free movement of the pair of push rods, the push rods 54, 56 are each received in elongated push rod guides 69, 71. Each push rod guide contains a pair of bushings 72 through which the associated push rod moves. The push rod guides are mounted on the sides of the gun 10 such as by bolts 73.

In the operation of the adhesive dispensing gun 10, when it is desired to dispense adhesive A on the substrate S, the valve ball 17 is moved away from the valve seat 18 to permit adhesive to flow from the chamber 43, past the valve seat, and onto the substrate through the extrusion head opening 46. The valve stem 21, which carries the valve ball 17, is moved away from the valve seat 18 under the influence of the pneumatic motor. As the valve stem 21 is linearly translated away from the extrusion head 16, the push rods 54, 56 are also linearly translated upwardly since both the push rods and the valve stem are coupled to the push rod beam 27. As the push rods are moved upwardly, the depressor bar 26 is also moved upwardly, returning the substrate S into contact with the extrusion head 16.

Therefore, as the adhesive is again supplied to the extrusion head by the opening of the adhesive valve, the substrate is also returned into contact with the extrusion head. During the initial flow of adhesive through the adhesive valve, as the valve ball 17 is moved away from the valve seat 18, the extrusion head is as yet not in contact with the substrate so that the adhesive does not trail onto the substrate gradually building up to a full flow rate. On the contrary, the substrate again contacts the extrusion head at substantially the time that the adhesive flow control valve is fully open, and therefore a sharp cut-on is effected in the adhesive application.

When it is desired to stop the flow of adhesive onto the substrate, such as at the end of an element of an intermittent pattern of adhesive applied to the substrate, the adhesive flow control valve is closed. This is accomplished by removing the air pressure from the pneumatic motor, permitting the valve stem 21 to move toward the extrusion head 16 under the influence of the spring 41. The valve ball 17 is received on the seat 18, stopping the flow of adhesive to the extrusion head. As the valve stem 21 moves downwardly to close the flow control valve, the push rods 54, 56 and the depressor bar 26 also move linearly downwardly to push the substrate S away from the extrusion head 16.

Therefore, residual flow of adhesive onto the substrate from the extrusion head is prevented as the adhesive flow control valve is closed since the extrusion head is no longer in contact with the substrate. This prevents the trailing off of adhesive when the valve is closed, such as at the end of an element of an intermittent pattern of adhesive on the substrate. In this way, sharp cut-off of adhesive is obtained.

While the invention has been described in connection with a hot melt adhesive dispensing gun, it will be understood that it is also applicable to other types of liquid dispensing guns. Also, while the mechanical coupling between the valve and the depressor bar has been shown in the form of linear translating push rods, other mechanical connections are possible such as rotating mechanical links or cams.

What is claimed is:

1. A dispensing gun, for applying a liquid to a substrate, including a gun body and a nozzle, the gun having a liquid storage chamber, a passage communicating between the liquid storage chamber and a source of the liquid to be applied, and a nozzle outlet communicating with the liquid storage chamber from which the liquid is dispensed onto the substrate, and further comprising:

valve means for controlling liquid flow from the liquid storage chamber to the nozzle outlet including a movable valve stem having a valve-opened position in which liquid flows through the nozzle outlet from the liquid storage chamber and a valve-closed position in which the flow of liquid from the liquid storage chamber is prevented;

means for moving the valve stem between said valve-opened and valve-closed positions;

a deflector element movably mounted on the gun substantially adjacent the substrate, the deflector element having a first position in which it has substantially no influence on the substrate and a second position in which the deflector element deflects the substrate out of contact with the nozzle; and means for moving the deflector element to its first position when the valve stem is moved to its valve-opened position and for moving the deflector element to its second position when the valve stem is moved to its valve-closed position.

2. The dispensing gun of claim 1 in which the means for moving the deflector element comprises at least one linearly translated push rod coupled between the movable valve stem and the deflector element for transmitting motion of the valve stem to the deflector element.

3. The dispensing gun of claim 2 in which the movable valve stem is linearly translated between its valve-opened position and its valve-closed position and in which the means for moving the valve stem comprises a pneumatically-operated, linearly-translated, piston coupled to the valve stem.

4. The dispensing gun of claim 3 in which the means for moving the deflector element comprises a pair of linearly translated push rods and further comprising a push rod beam, each of the push rods being coupled at a first end to the deflector element and at a second end to the push rod beam, which is also coupled to said piston, whereby linear translation of the valve stem and piston effects linear translation of the push rod beam, the pair of push rods, and the deflector element.

5. The dispensing gun of claim 4 which further comprises a pair of push rod guides, each of the push rod guides receiving a different one of the pair of push rods.

6. A dispensing gun, for applying a liquid to a substrate, including a gun body and a nozzle, the gun having a liquid storage chamber, a passage communicating between the liquid storage chamber and a source of the liquid to be applied, and a nozzle outlet communicating with the liquid storage chamber from which the liquid is dispensed onto the substrate, and further comprising:

a valve including a linearly translated valve stem for controlling liquid flow from the liquid storage chamber to the nozzle outlet, the valve stem being movable between a valve-opened position in which liquid flows through the nozzle outlet from the liquid storage chamber and a valve-closed position in which the flow of liquid from the liquid storage chamber is prevented;

a pneumatically actuated piston coupled to the valve stem for moving the valve stem between said valve-opened and valve-closed positions;

an elongated depressor bar movably mounted on the gun substantially adjacent the substrate, the depressor bar having a first position in which it has substantially no influence on the substrate and a second position in which the deflector element deflects the substrate out of contact with the nozzle;

a pair of push rods supported on the gun for linear translation, each coupled at a first end to the elongated depressor bar and having a second end; and a push rod beam attached to said valve stem piston and to the second ends of the push rods, whereby movement of the valve stem under the influence of the pneumatically actuated piston effects translation of the push rod beam, push rods, and elongated depressor bar so that moving the valve stem to its valve-opened position results in movement of the depressor bar to its first position and movement of the valve stem to its valve-closed position results in movement of the depressor bar to its second position.

7. The dispensing gun of claim 6 which includes an elongated nozzle and in which the elongated depressor bar is spaced apart from and coextensive with the nozzle.

8. A dispensing gun, for applying a liquid to a substrate, including a gun body and a nozzle, the gun having a liquid storage chamber, a passage communicating between the liquid storage chamber and a source of the liquid to be applied, and a nozzle outlet communicating with the liquid storage chamber from which the liquid is dispensed onto the substrate, and further comprising:

valve means for controlling the liquid flow from the liquid storage chamber to the nozzle outlet including a movable valve stem having a valve-opened position in which liquid flows through the nozzle outlet from the liquid storage chamber and a valve-closed position in which the flow of liquid from the liquid storage chamber in prevented;

means for moving the valve stem between said valve-opened and valve-closed positions;

a deflector element movably mounted on the gun substantially adjacent the substrate, the deflector element having a first position in which it has substantially no influence on the substrate and a second position in which the deflector element deflects the substrate out of contact with the nozzle; and means for coupling movement of the valve stem to the deflector element to move the deflector element to its first position when the valve stem is moved to its valve-opened position and for moving the deflector element to its second position when the valve stem is moved to its valve-closed position.

* * * * *